US005181973A

United States Patent [19]

Hirose et al.

[11] Patent Number: 5,181,973

[45] Date of Patent: Jan. 26, 1993

[54] SINTERED PERMANENT MAGNET

[75] Inventors: Kazunori Hirose; Shinya Hashimoto, both of Chiba; Koichi Yajima, Saitama, all of Japan

[73] Assignee: TDK Corporation, Tokyo, Japan

[21] Appl. No.: 723,970

[22] Filed: Jul. 1, 1991

[51] Int. Cl.[5] ..... H01F 1/053

[52] U.S. Cl. ..... 148/302; 420/83; 420/121; 75/244

[58] Field of Search ..... 148/302; 420/83, 121; 75/244

[56] References Cited

U.S. PATENT DOCUMENTS 4,859,255 8/1989 Fujimura et al. ..... 148/302

FOREIGN PATENT DOCUMENTS 0311049 4/1989 European Pat. Off. ..... 148/302

OTHER PUBLICATIONS

Nikkei New Materials, Jul. 9, 1990, p. 31.

Nihon Kogyo Shinbun (Japan Industrial News), Jun. 14, 1990.

Koichi Yajima, "Refractory Neodium Base Sintered Magnets", MotorTech Japan '91/New Magnetic Materials and Their Application, Feb. 28, 1991, Session A-3, pp. 1-1-1-8.

*Primary Examiner*—John P. Sheehan

*Attorney, Agent, or Firm*—Oblon, Spivak, McClelland, Maier & Neustadt

[57] ABSTRACT

The sintered permanent magnet of the invention has a composition of the formula:

$$(R_{1-\alpha}Dy_{\alpha})_aFe_{(100-a-b-c-d-e)}B_bAl_cSn_dM_e$$

wherein R is at least one rare earth element exclusive of Dy, M is at least one element selected from the group consisting of Co, Nb, W, V, Ta, Mo, Ti, Ni, Bi, Cr, Mn, Sb, Ge, Zr, Hf, Si, In, and Pb, and $0.01 \leqq \alpha 0.5$, $8 \leqq a \leqq 30$, $2 \leqq b \leqq 28$, $0.2 \leqq c \leqq 2$, $0.03 \leqq d \leqq 0.5$, and $0 \leqq e \leqq 3$. The sintered permanent magnet of R-Fe-B system has excellent thermal stability and high maximum energy product.

2 Claims, No Drawings

SINTERED PERMANENT MAGNET

BACKGROUND OF THE INVENTION

1. Field of the Invention

This invention relates to a sintered permanent magnet of an R-Fe-B system, that is, containing R (R is a rare earth element inclusive of Y throughout the disclosure), Fe and B.

2. Prior Art

Typical of high performance rare earth magnets are powder metallurgical Sm-Co base magnets having an energy product of the order of 32 MGOe which have been commercially produced in a mass scale. These magnets, however, undesirably use expensive raw materials Sm and Co. Among the rare earth elements, those elements having a relatively low atomic weight, for example, Ce, Pr and Nd are available in plenty and less expensive compared to Sm. Further Fe is less expensive than Co.

From these aspects, R-Fe-B system magnets such as Nd-Fe-B magnets were recently developed as seen from Japanese Patent Application Kokai No. 46008/1984 disclosing sintered magnets and Japanese Patent Application Kokai No. 9852/1985 disclosing rapidly quenched ones.

For sintered magnets, the powder metallurgical process of the conventional Sm-Co system (melting→casting→ingot crushing→fine milling→compacting→sintering→magnet) is applicable and high magnet performance is expectable. The R-Fe-B magnets, however, are less heat stable than the Sm-Co magnets as demonstrated by a differential coercivity $\Delta iHc/\Delta T$ as great as $-0.60$ to $-0.55\%/°C.$ in the range of from room temperature to 180° C., and a significant, irreversible demagnetization upon exposure to elevated temperatures. Therefore, the R-Fe-B magnets are rather impractical when it is desired to apply them to equipment intended for high temperature environment service, for example, electric and electronic devices in automobiles.

For reducing the irreversible demagnetization of R-Fe-B magnets by heating, Japanese Patent Application Kokai No. 165305/1987 proposes to substitute Dy for part of Nd and Co for part of Fe.

Although Dy substitution can improve coercive force iHc at room temperature and Co substitution can increase iHc and improve $\Delta Br/\Delta T$ to some extent, the inventors have found that it is impossible to achieve a substantial reduction of $\Delta iHc/\Delta T$ by merely adding Dy and Co. As shown in the above-cited patent publication, samples having larger amounts of Dy substituted have relatively low percent irreversible demagnetization, but at the sacrifice of maximum energy product (BH) max.

SUMMARY OF THE INVENTION

An object of the present invention is to provide an R-Fe-B sintered permanent magnet having improved thermal stability and excellent magnetic properties, especially maximum energy product as well as a method for preparing the same.

This and other objects are attained by a sintered permanent magnet as defined by the following formula.

$$(R_{1-\alpha}Dy_{\alpha})_aFe_{(100-a-b-c-d-e)}B_bAl_cSn_dM_e$$

In the formula,

R is at least one rare earth element exclusive of Dy,

M is at least one element selected from the group consisting of Co, Nb, W, V, Ta, Mo, Ti, Ni, Bi, Cr, Mn, Sb, Ge, Zr, Hf, Si, In, and Pb, and letters $\alpha$, a, b, c, d, and e are:

$0.01 \leqq \alpha \leqq 0.5$,
$8 \leqq a \leqq 30$,
$2 \leqq b \leqq 28$,
$0.2 \leqq c \leqq 2$,
$0.03 \leqq d \leqq 0.5$, and
$0 \leqq e \leqq 3$.

A sintered permanent magnet having a composition of the above-defined formula is prepared by a method comprising the steps of: shaping an alloy powder having the corresponding composition into a compact, firing the compact, and effecting first stage aging at 700° to 1,000° C. and second stage aging at 400° to 650° C.

BENEFITS OF THE INVENTION

Due to the inclusion of Dy as a rare earth element and minor amounts of Sn and Al as essential elements, the R-Fe-B sintered permanent magnets of the present invention exhibit a high coercive force, a low temperature differential of coercive force $\Delta iHc/\Delta T$, and reduced irreversible demagnetization on heating. Since the inclusion of Al and Sn in quite minor amounts in the above-defined range can significantly improve thermal stability, it is only necessary to add Dy in a sufficiently smaller amount to minimize a lowering of maximum energy product.

The sintered permanent magnets of the invention are significantly heat stable, for example, in that the temperature at which a percent demagnetization of 5% or lower is reached at a permiance coefficient of 2 is 250° C. or higher and the magnitude of $\Delta iHc/\Delta T$ in the range between room temperature and 180° C. is as small as 0.45%/°C. or lower. Consequently, the magnets can perform stably even in a very high temperature environment as found in automobile hoods and air suspensions. Therefore, the present invention provides a sintered permanent magnet of R-Fe-B system characterized by very high thermal stability and a high maximum energy product.

DESCRIPTION OF THE PREFERRED EMBODIMENTS

The construction of the present invention will be illustrated in detail.

The sintered permanent magnet of the invention has a composition of the following formula.

$$(R_{1-\alpha}Dy_{\alpha})_aFe_{(100-a-b-c-d-e)}B_bAl_cSn_dM_e$$

In the formula, R is at least one rare earth element exclusive of Dy, M is at least one element selected from the group consisting of Co, Nb, W, V, Ta, Mo, Ti, Ni, Bi, Cr, Mn, Sb, Ge, Zr, Hf, Si, In, and Pb, and letters $\alpha$, a, b, c, d, and e are:

$0.01 \leqq \alpha \leqq 0.5$,
$8 \leqq a \leqq 30$,
$2 \leqq b \leqq 28$,
$0.2 \leqq c \leqq 2$,
$0.03 \leqq d \leqq 0.5$, and
$0 \leqq e \leqq 3$.

It will be appreciated that letters $\alpha$, a, b, c, d, and e represent atomic ratios of the associated elements.

The rare earth elements used herein include Y, lanthanides, and actinides. Preferably, R is at least one member selected from the group consisting of Nd, Pr, and Tb, and may further contain at least one member selected from the group consisting of La, Ce, Gd, Er, Ho, Eu, Pm, Tm, Yb, and Y.

It is to be understood that misch metal, didymium alloys and other mixtures may be used as rare earth element source materials.

If a representative of the total content of R and Dy is below the above-defined range, the resulting alloy becomes a cubic grain structure of the same system as alpha-iron and no longer has a high coercive force iHc. If a is beyond the above-defined range, the residual magnetic flux density Br lowers due to an increased proportion of a rare earth element rich non-magnetic phase.

The preferred range of a is $10 \leqq a \leqq 20$.

Dy is effective for improving thermal stability in order to improve iHc in a temperature range of from room temperature to high temperatures. If $\alpha$ representative of the proportion of Dy in the rare earth elements is below the above-defined range, thermal stability becomes poor.

The preferred range of $\alpha$ is $0.15 \leqq \alpha \leqq 0.30$, more preferably $0.15 \leqq \alpha \leqq 0.25$.

If b representative of the content of boron B is below the above-defined range, the resulting rhombohedral structure has low iHc. If b is beyond the above-defined range, Br lowers due to an increased proportion of a boron rich non-magnetic phase.

The preferred range of b is $5 \leqq b \leqq 10$.

Al and Sn are effective for reducing $\Delta iHc/\Delta T$ and improving iHc at elevated temperatures. Thus the inclusion of both Al and Sn ensures quite high thermal stability.

If either of c and d representative of the Al and Sn contents, respectively, is below the above-defined range, it becomes difficult to provide very high thermal stability. If c exceeds the above-defined range, then Br lowers. If d exceeds the above-defined range, then iHc at room temperature drastically drops and Br lowers.

The preferred ranges of c and d are $0.5 \leqq c \leqq 1.3$ and $0.1 \leqq d \leqq 0.3$.

Additive elements M are added for their own purpose.

Addition of a minor amount of Co will improve oxidation resistance. Addition of at least one element selected from the group consisting of Nb, W, V, Ta, Mo, Ti, Cr, Mn, Sb, Ge, Zr, Hf, Si, In, and Pb will improve magnetic properties, and particularly, squareness is improved by adding Nb, W and V.

If e representative of the M content is above the above-defined range, there results a drastic drop of Br.

The preferred range of e is $0.5 \leqq e \leqq 2$.

In addition to the above-mentioned elements, incidental impurities such as Cu, Ca, $O_2$, Mg and the like may be present up to 5 atom % of the total composition.

Further, efficient manufacture and cost reduction are expectable by substituting at least one member of C, P, S, and N for part of the boron. The substitution amount should preferably be up to 3 atom % of the total composition.

The sintered permanent magnet of the above-mentioned composition has a major phase of substantially tetragonal grain structure and usually, contains about 0.5 to 10% by volume of a non-magnetic phase. It has a mean grain size of about 2 to 6 μm.

The permanent magnet of the invention is prepared by a sintering method. Any desired type of sintering method may be used although the following method is preferred.

First of all, an alloy material having the intended composition is cast to form an alloy ingot.

The alloy ingot is crushed to a particle size of about 10 to 100 μm by means of a stamp mill or the like, and then finely milled to a particle size of about 0.5 to 10 μm by means of a ball mill, jet mill or the like.

The finely milled powder is then compacted. Any suitable compacting pressure may be used although a pressure of about 1 to 5 t/cm$^2$ is preferred. Compacting is preferably carried out in a magnetic field. The magnetic field intensity is not particularly limited although an intensity of 10 kOe or higher is preferred.

The compact is then fired. The firing conditions are not particularly limited although it is preferred to fire the compact at 1,000° to 1,200° C. for ½ to 12 hours followed by quenching. The preferred firing atmosphere is vacuum or an inert gas atmosphere such as Ar gas.

After firing, the compact is subject to aging treatment. In the practice of the invention, aging treatment is done in two stages. The first stage of aging treatment is at 700° to 1,000° C. for about ½ to 2 hours, with subsequent cooling being at a preferred rate of about 10° C./min. or higher.

The second stage of aging treatment is at 400° to 650° C. for about ½ to 2 hours, with subsequent cooling being at a preferred rate of about 10° C./min. or higher. Preferably, the aging treatment is performed in an inert gas atmosphere.

At the end of aging treatment, the product is magnetized if necessary.

EXAMPLE

Examples of the present invention are given below by way of illustration.

EXAMPLE 1

Magnet samples of the compositions shown in Table 1 were prepared by the following method.

First, an alloy ingot was prepared by casting. The alloy ingot was crushed to −32 mesh by means of a jaw crusher and Brown mill, and then finely milled by means of a jet mill. The fine powder was compacted under a pressure of 1.5 t/cm$^2$ in a magnetic field of 12 kOe. The compact was fired at 1,080° C. for 2 hours and then quenched, obtaining a sintered body.

The sintered body was subjected to two stages of aging treatment in an argon atmosphere and then magnetized. The first stage of aging treatment was at 850° C. for one hour, with subsequent cooling at 15° C./min. The second stage of aging treatment was at 600° C. for one hour, with subsequent cooling at 15° C./min.

Each of the thus prepared samples was examined for iHc, (BH)max, and $\Delta iHc/\Delta T$ over 25°-180° C. by means of a BH tracer and a vibrating sample magnetometer (VSM). The results are shown in Table 1.

Each sample was processed so as to provide a permiance coefficient of 2, magnetized in a magnetic field of 50 kOe, stored for two hours in a constant temperature tank, and finally cooled down to room temperature, before it was measured for percent irreversible demagnetization by means of a flux meter. The temperature at which a percent irreversible demagnetization of 5% was reached is reported under the heading T(5%) in Table 1.

TABLE 1

| Sample No. | Composition (at %) | iHc (kOe) | (BH)max (MGOe) | T(5%) (°C.) | ΔiHc/ΔT (%/°C.) |
|---|---|---|---|---|---|
| 1* | $Nd_{15}Fe_{78}B_7$ | 15 | 38 | 80 | −0.60 |
| 2* | $Nd_{12}Dy_3Fe_{78}B_7$ | 26 | 35 | 160 | −0.57 |
| 3* | $Nd_{12}Dy_3Fe_{77}Al_1B_7$ | 30 | 33 | 200 | −0.55 |
| 4 | $Nd_{12}Dy_3Fe_{76.9}Al_1B_7Sn_{0.1}$ | 27 | 32 | 250 | −0.43 |
| 5 | $Nd_{12}Dy_3Fe_{76.8}Al_1B_7Sn_{0.2}$ | 26 | 30 | 260 | −0.42 |
| 6* | $Nd_{12}Dy_3Fe_{76}Al_1B_7Sn_1$ | 17 | 20 | 90 | −0.58 |
| 7* | $Nd_{12}Dy_3Fe_{77.9}B_7Sn_{0.1}$ | 23 | 33 | 200 | −0.52 |
| 8* | $Nd_{12}Dy_3Fe_{76.99}Al_1B_7Sn_{0.01}$ | 28 | 33 | 210 | −0.51 |
| 9 | $Nd_{12}Dy_3Fe_{75.9}Al_1B_7Sn_{0.1}Co_1$ | 25 | 32 | 260 | −0.42 |
| 10* | $Nd_{12}Dy_3Fe_{77}B_7Co_1$ | 22 | 34 | 200 | −0.55 |
| 11 | $Nd_{12}Dy_3Fe_{76.4}Al_1B_7Sn_{0.1}Nb_{0.5}$ | 26 | 29 | 250 | −0.43 |
| 12 | $Nd_{12}Dy_3Fe_{76.4}Al_1B_7Sn_{0.1}W_{0.5}$ | 25 | 30 | 250 | −0.43 |
| 13* | $Nd_{9.5}Pr_{2.5}Dy_3Fe_{77}Al_1B_7$ | 32 | 33 | 190 | −0.56 |
| 14* | $Nd_{9.5}Pr_{2.5}Dy_3Fe_{77.9}B_7Sn_{0.1}$ | 24 | 33 | 190 | −0.54 |
| 15* | $Nd_{9.5}Pr_{2.5}Dy_3Fe_{77}B_7Co_1$ | 23 | 34 | 190 | −0.56 |
| 16 | $Nd_{9.5}Pr_{2.5}Dy_3Fe_{76.9}Al_1B_7Sn_{0.1}$ | 28 | 32 | 250 | −0.44 |
| 17 | $Nd_{9.5}Pr_{2.5}Dy_3Fe_{75.9}Al_1B_7Sn_{0.1}Co_1$ | 26 | 32 | 250 | −0.43 |

*Comparison

The benefits of the present invention are evident from the data of Table 1. More specifically, samples containing predetermined amounts of Al and Sn within the scope of the invention have a significantly reduced magnitude (absolute value) of ΔiHc/ΔT of lower than 0.45%/° C. and a fully high temperature of 250° to 260° C. at which a percent irreversible demagnetization of 5% is reached, indicating that they are fully heat stable. They also have high values of (BH)max.

On the contrary, comparative samples containing neither of Al and Sn and comparative samples containing either one of Al and Sn have a large magnitude of ΔiHc/ΔT of higher than 0.52%/° C. and a temperature of lower than 200° C. at which a percent irreversible demagnetization of 5% is reached, indicating that they are less heat stable. Although the samples using Co, Nb and W as additive element M were reported in Table 1, equivalent results were obtained when at least one element selected from the group consisting of V, Ta, Mo, Ti, Ni, Bi, Cr, Mn, Sb, Ge, Zr, Hf, Si, In, and Pb was added instead of or in addition to these elements.

We claim:

1. A sintered permanent magnet having a composition of the formula:

$$(R_{1-\alpha}Dy_\alpha)_aFe_{(100-a-b-c-d-e)}B_bAl_cSn_dM_e$$

wherein

R is at least one rare earth element exclusive of Dy,

M is at least one element selected from the group consisting of Co, Nb, W, V, Ta, Mo, Ti, Ni, Bi, Cr, Mn, Sb, Ge, Zr, Hf, Si, In, and Pb, and letters $\alpha$, a, b, c, d, and e are:

$0.01 \leqq \alpha \leqq 0.5$, $8 \leqq a \leqq 30$, $2 \leqq b \leqq 28$, $0.2 \leqq c \leqq 2$, $0.03 \leqq d \leqq 0.5$, and $0 \leqq e \leqq 3$.

2. The sintered permanent magnet of claim 1 wherein R is at least one member selected from the group consisting of Nd, Pr, and Tb.

* * * * *